US006082490A

United States Patent [19]

Rowland

[11] Patent Number: 6,082,490

[45] Date of Patent: Jul. 4, 2000

[54] MODULAR ANECHOIC PANEL SYSTEM AND METHOD

[76] Inventor: Chris W. Rowland, 4017 Victory Dr. #149, Austin, Tex. 78704

[21] Appl. No.: 08/893,008

[22] Filed: Jul. 15, 1997

[51] Int. Cl.[7] ..... E04B 1/82

[52] U.S. Cl. ..... 181/295; 181/30

[58] Field of Search ..... 181/284, 285, 181/286, 287, 290, 292, 293, 294, 295, 30

[56] References Cited

U.S. PATENT DOCUMENTS

| | | | |
|---|---|---|---|
| 3,049,204 | 8/1962 | Sorenson | 181/295 |
| 3,421,273 | 1/1969 | Eckel | 181/295 |
| 3,509,964 | 5/1970 | Eckel | 181/295 |
| 3,712,413 | 1/1973 | Eckel | 181/295 |
| 3,735,837 | 5/1973 | Duda et al. | 181/295 |
| 5,317,113 | 5/1994 | Duda | 181/286 |

*Primary Examiner*—Khanh Dang

[57] ABSTRACT

The modular anechoic panel system provides modular anechoic panels for construction of anechoic chambers particularly advantageous for use in sound testing and measurement. The modular anechoic panel incorporates into a single structural member the elements of structural support, transmission loss features, and the wedge base and air space elements of an anechoic wedge thus providing enhanced protection to elements of the anechoic wedge. The modular anechoic panels provides a durable structural member and, as assembled, form a structural shell of an anechoic chamber having a reduced footprint. Additionally, the modular anechoic panel provides a compression clip mounting system for conveniently mounting and replacing wedge tips, thus allowing for use of standard wedge tip materials and easy assembly, repair and replacement of damaged wedge tips.

21 Claims, 9 Drawing Sheets

MODULAR ANECHOIC PANEL SYSTEM AND METHOD

TECHNICAL FIELD

This patent application generally relates to anechoic chambers and in particular to a modular anechoic panel system and method.

BACKGROUND OF THE INVENTION

The character and quality of noise emitted from manufactured products has become increasingly important to the function and marketability of such manufactured products. Product manufacturers, governments, and standard setting organizations often require consumer and industrial products and equipment to comply with increasingly stringent sound emission specifications. Accordingly, a large number of consumer products and industrial equipment must now undergo sound emission testing.

Anechoic chambers using acoustical anechoic wedges are frequently employed in such sound emissions tests. According to previous techniques, an anechoic chamber consists of a shell constructed of material to provide structural stability and predictable transmission loss characteristics from the exterior of the anechoic chamber to the interior of the anechoic chamber and an array of sound-absorbing anechoic wedge devices ("anechoic wedges") lining the shell's interior surfaces to eliminate interior reflected sound. Materials used in the construction of shells for anechoic chambers have included various materials, such as masonry, wood, and metal. Shell designs have included permanent shell structures as well as semi-permanent shells constructed of modular interlocking structural panels. Anechoic chambers with anechoic wedges or other linings on all interior surfaces are typically referred to as "full" anechoic chambers, while chambers having linings on only the walls and ceiling are referred to as "hemi" anechoic chambers. Anechoic chambers, both hemi and full, are used in the testing and or measurement of sound characteristics emitted by a specimen being tested or calibrated. To increase sound absorbency in anechoic chambers, conventional industry practice has been to mount anechoic wedges having a wedge tip, wedge base, and air space elements in an array of alternating groupings of horizontal and vertical wedges over the entire interior surface of the anechoic chamber. Industry standards dictate that anechoic wedges should achieve greater than 90% sound absorption at the lowest frequency to be measured (the "cut-off frequency"). The shape, dimensions and composition of an anechoic wedge are governed by mathematical equations well known in the art. The size and dimensions of an anechoic chamber depend upon the size of the specimen to be tested and upon the frequency range to be measured. For example, small computer devices and equipment may only require an anechoic chamber the size of a medium-sized room whereas large construction equipment and jet airplanes may require a chamber as large as an airplane hanger.

The anechoic chamber preferably should be capable of testing specimens at a broad spectrum of cut-off frequencies. The cut-off frequency similarly governs the chamber's dimensions. To achieve accurate low-frequency measurements, the measuring equipment should be located a sufficient distance from the equipment being tested and from the chamber's wall. ANSI standards specify that a measuring microphone be located no closer than one meter to the specimen and no closer than ¼ of the wavelength of the cut-off frequency to the tip of the anechoic wedge.

Similarly, the necessary depth of an anechoic wedge is inversely proportional to the specified cut-off frequency. Like the anechoic chamber itself, as the specified cut-off frequency decreases, the wedge depth of a standard anechoic wedge must increase in proportion to the cut-off frequency's wave length in order to obtain sufficient low frequency sound absorption. Specifically, the wedge depth may be no less than ¼ of the wavelength of the cut-off frequency. Accordingly, as the cut-off frequency to be measured decreases, the necessary size and dimensions of the anechoic wedges and the anechoic chamber increase. As the specified cut-off frequency decreases, the wavelength of the cut-off frequency and the wedge depth and the size of the anechoic chamber increase proportionately. The increase in wedge depth can often be significant. For example, the industry standard cut-off frequency of 125 hertz would have a wavelength of 2.76 meters and require a wedge depth of 0.7 meters, whereas a lower cut-off frequency of 50 hertz would have a cut-off frequency of approximately 6.9 meters and require a wedge depth of approximately 1.72 meters.

This increase in required wedge depth has presented unique problems for the design of anechoic chambers. Increased wedge depth results in an exponential increase in both the volume and cost of sound absorptive material needed to construct the anechoic wedges. Similarly, the increased size of the needed anechoic wedge also causes a corresponding increase in the necessary footprint for the anechoic chamber. Unfortunately, due to the low-rigidity of most sound absorptive materials, standard anechoic wedges exceeding a certain wedge depth may bend or break from their mounts under their own weight. At larger sizes, standard anechoic wedges also become extremely cumbersome, difficult to manipulate, and difficult to mount using conventional mounting systems.

Also, given the increasing variety of products, industrial machinery, and equipment now being tested, anechoic chambers used to conduct such sound tests are exposed to more rigorous environments. Exposure to such rigorous environments frequently results in damage to and requires the replacement of the delicate sound-absorbing anechoic wedge tips used in such anechoic chambers.

Several techniques have been employed to strengthen and protect the anechoic wedges. One previous technique has been to enshroud the wedge tip and wedge base elements of the anechoic wedge with a wire cloth framework to provide structural support. Unfortunately, the overall size or cost of the wedge is not significantly affected and the direct introduction of such reflective material into the anechoic chamber may result in sound reflections which reduce the accuracy of the measurements. Another attempt at addressing this problem is demonstrated by the sound absorbing unit described in U.S. Pat. No. 5,317,113 in which perforated metal is used to shape, contain and protect the wedge material. Sound absorption may be sacrificed compared with a standard anechoic wedge. According to another previous technique, the wedge tip and wedge base are joined into an integral unit by an exterior housing. To form the air space element of the anechoic wedge, the housing containing the anechoic wedge base and tip is suspended or offset mounted approximately 3" to 4" inches away from the anechoic chamber's inner surface to create the air space important to the function of the anechoic wedge. Several methods are known in the art for mounting the wedge elements in this fashion, including the use of furring strips to offset mount housings containing a configuration of wedge base and wedge tips. Unfortunately, the use of frameworks and offset mounting of the anechoic wedges has turned out to be both costly and maintenance intensive. Typically, damaged wedges cannot be replaced without significant effort and expenses. Often, to replace a single wedge tip, an entire series of wedges must be removed from their mountings.

Thus, a need has arisen for an efficient anechoic wedge system for anechoic chambers that would employ traditional wedge materials while minimizing the overall size necessary for the wedge and room and providing sufficient protection to the anechoic wedge elements. Similarly, it would be advantageous to provide a mounting system or method which would protect the anechoic wedge from damage and would permit ease of mounting, repairing and replacing of the anechoic wedges.

SUMMARY

The modular anechoic panel system of the illustrative embodiment advantageously provides structural modular anechoic panels for the assembly of wall, roof and/or floor components of an anechoic chamber. Each modular anechoic panel is structurally self supporting and contains the acoustical wedge base and air space elements of an anechoic wedge. In the illustrative embodiment, an acoustically transparent interior shelf and a structural face plate retain the wedge base, air space, and transmission loss material in position within the modular anechoic panel's structural steel frame. H-joints permit numerous modular anechoic panels to connect to one another to form a shell such that each panel's face plate becomes a portion of the interior surface of the assembled anechoic chamber. Additionally, a wedge tip compression clip system allows selective mounting of the wedge tips flush to the surface of the face plates.

It is technical advantage that the incorporation of the anechoic wedge elements with each modular anechoic panel forming the anechoic chamber's structural shell permits the absorption of sound in an anechoic chamber having a reduced overall room footprint.

In addition, the illustrative embodiment provides a modular design that provides a level of protection to many elements of the acoustic wedge, and is cost efficient to manufacture, assemble, and maintain relative to previous techniques. Moreover, the compression clip system of the illustrative embodiment provides for ease of installation, maintenance, and repair of wedge tips, which are susceptible to exposure and damage. Should a wedge tip become unacceptably soiled or otherwise damaged it can be removed and replaced by hand and at far lessor cost than conventional means.

DETAILED DESCRIPTION

An illustrative embodiment of the present invention and its advantages are better understood by reference to FIGS. 1 through 13.

Figure 1:
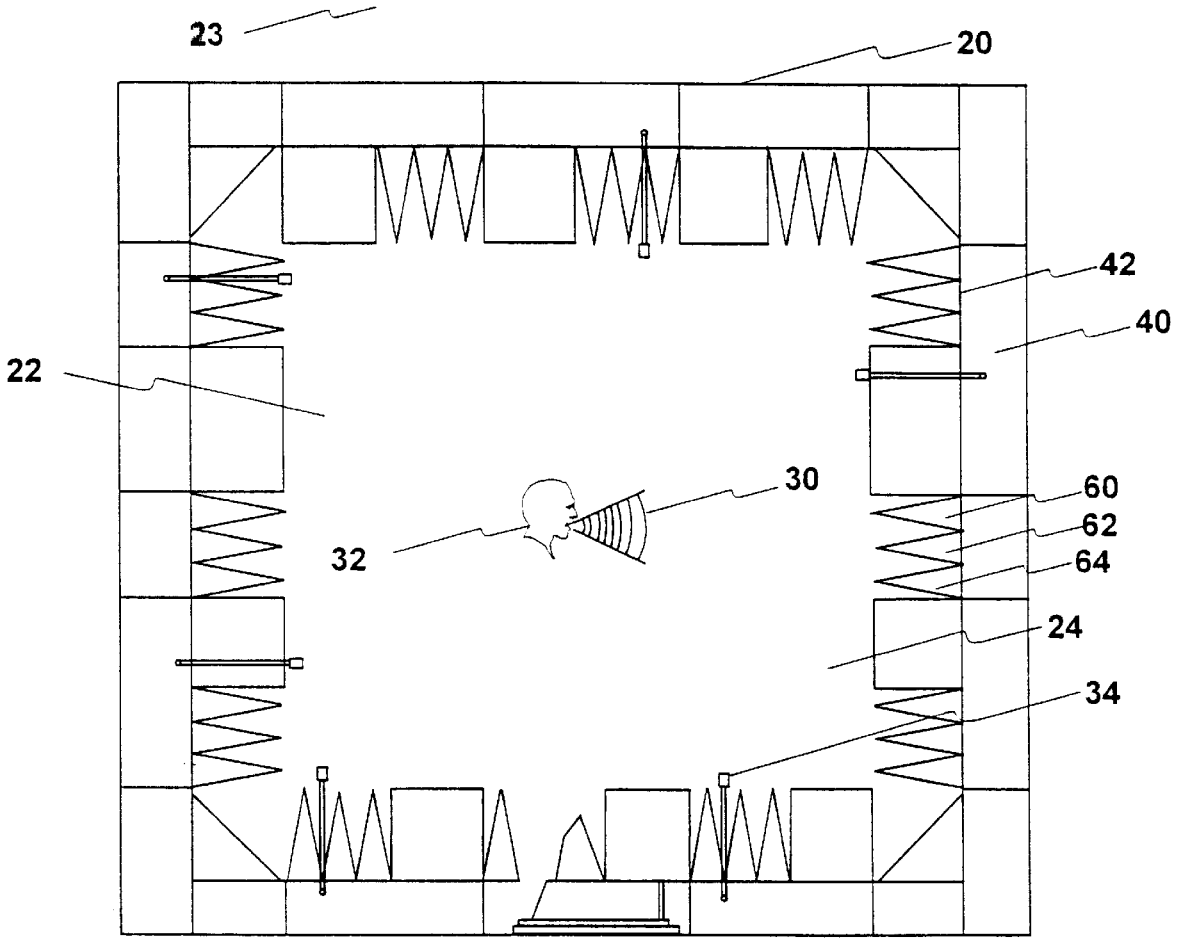
FIG. 1 is an overhead plan view of an illustrative embodiment of an anechoic chamber employing the modular anechoic panel system.

FIG. 1 shows an anechoic chamber 20 constructed from an illustrative embodiment of modular anechoic panels 40 utilizing the modular anechoic panel system. The anechoic chamber 20 absorbs sound emissions 30 to create an essentially echo-free room 22 in which acoustically free field conditions exist. These echo-free conditions within the anechoic chamber 20 allow for precise acoustical measurements to be taken of the sound-pressure levels and frequency emissions from specimen 32, such as equipment and products.

During product testing, a test specimen 32 may be positioned in the anechoic chamber 20 along with microphones 34 and other sound measurement instruments. To increase the accuracy of sound measurements, the testing instruments preferably measure only the direct sound emissions 30 of the test specimen 32. Thus, the anechoic chamber 20 preferably reduces all reflected sound within the room 22 and filters extraneous noise from sources emanating from the exterior 23 of the anechoic chamber 20. By reducing reflected and extraneous sound, the anechoic chamber 20 enhances the accuracy of the measurement and analysis of the sound emissions 30 actually generated by the test specimen 32.

Figure 2:
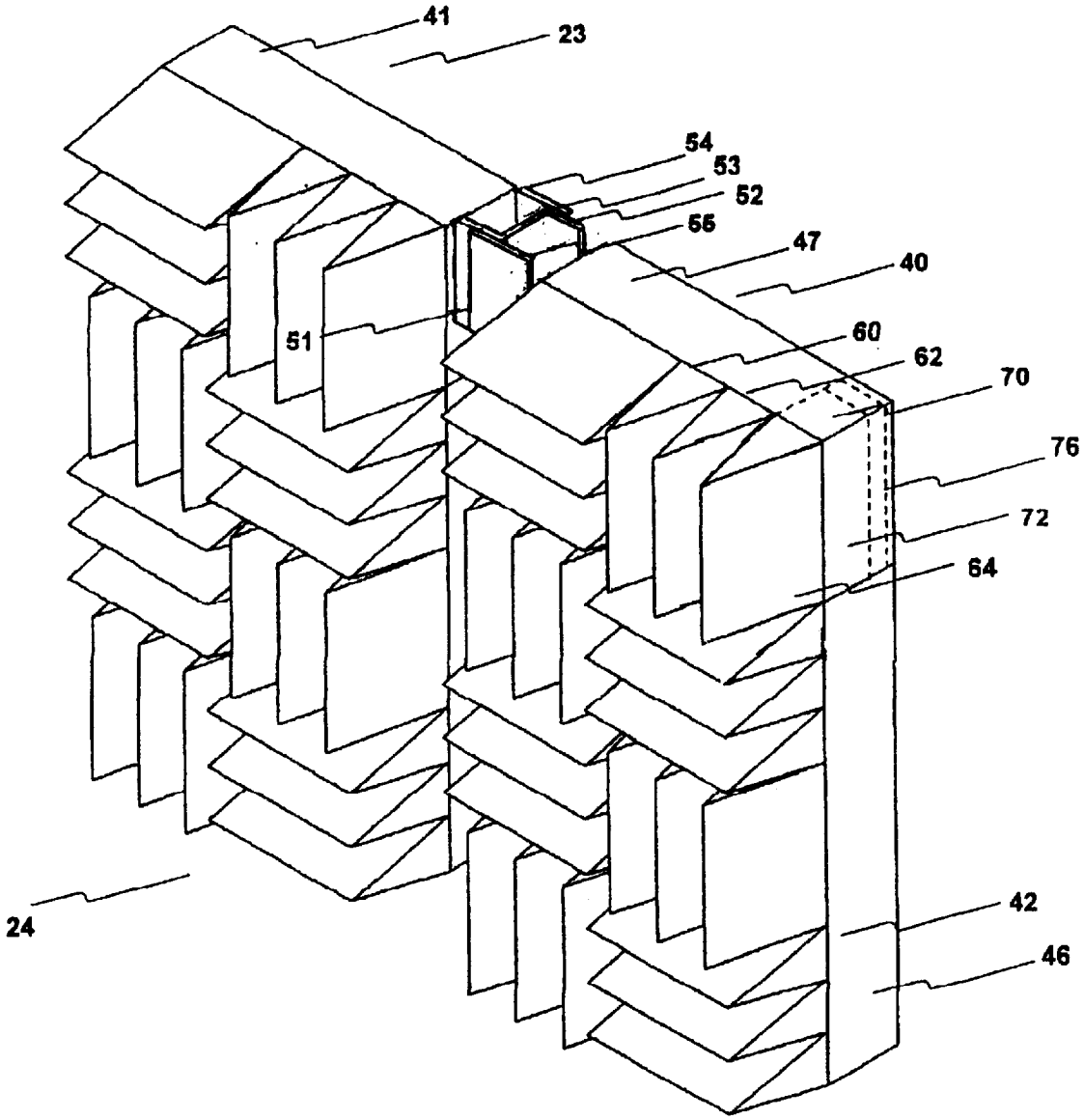
FIG. 2 is an isometric view showing the method of joining a pair of modular anechoic panels and further highlighting the positioning of the anechoic wedge elements.

Preferably, as shown in greater detail in FIG. 2, an H-joint 51 interconnects successive pairs of modular anechoic panels 40 and 41 to form anechoic chamber 20. To reduce sound leak-through, Z-shaped member 52 eliminates any direct sound path between the exterior 23 and the interior 24 of the anechoic chamber 20. To form each H-joint 51, spot welds 53 attach longitudinal beams 54 and 55 to Z-shaped member 52. Sound leak-through may be further reduced through other well-known construction techniques such as the application of caulking to any mating surfaces.

In the modular anechoic panel system of the illustrative embodiment, successive pairs of modular anechoic panels 40 and 41 join to form wall, roof, and floor sections of anechoic chamber 20. Joinder of floor, roof, and/or wall sections may be accomplished through the application of techniques well known in the art to a person of ordinary skill. Accordingly, anechoic chambers 20 of various sizes may be assembled using selected quantities of modular anechoic panels 40.

In the illustrative embodiment, a series of wedge tips 60, 62, and 64 mount to the interior surface 42 of each modular anechoic panel 40. Compression clips 140 and 142 selectively retain wedge tips 60, 62, and 64 flush to interior surface 42 of modular anechoic panel 40.

Figure 3:
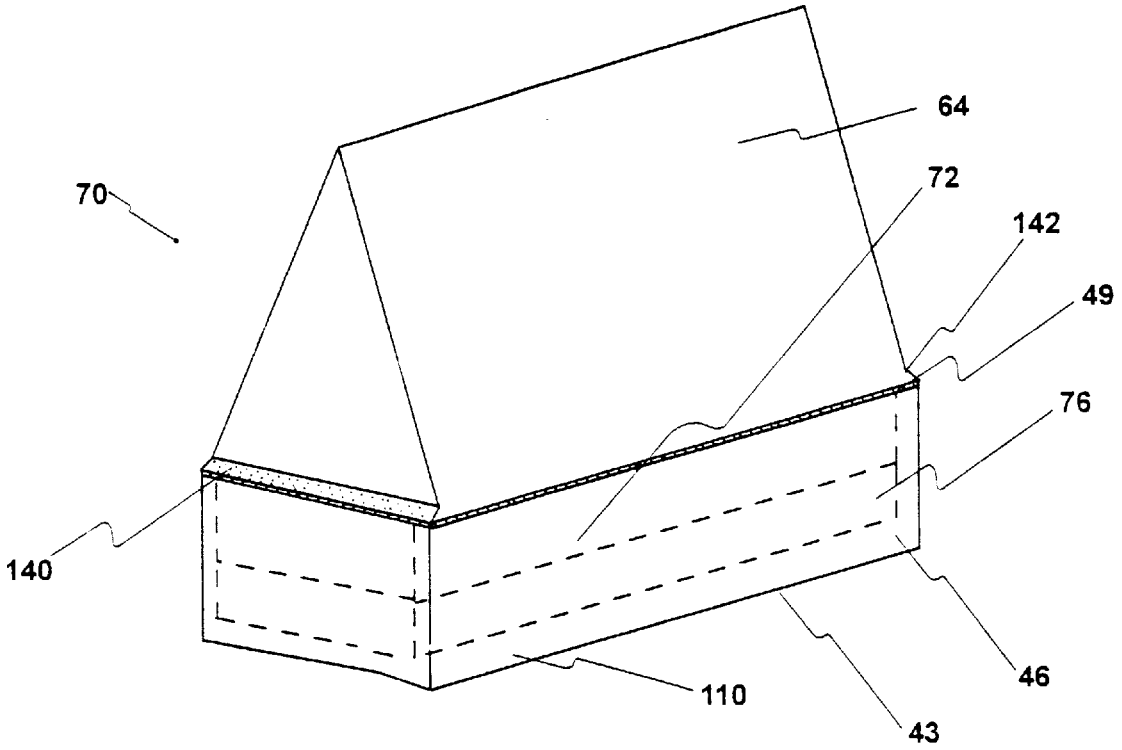
FIG. 3 depicts an isometric view of the anechoic wedge elements contained in a portion of the illustrative embodiment.

As further shown in FIG. 3, wedge tip 64 and the internal components of modular anechoic panel 40 constitute an anechoic wedge 70. According to previous techniques, anechoic wedges are sound-absorptive acoustical devices for absorbing incident sound, thereby eliminating sound reflections. Anechoic wedge 70 creates a frequency specific, essentially sound reverberation free environment within anechoic chamber 20.

Anechoic wedge 70 is composed of three critical elements necessary to achieve effective sound absorption: wedge tip 64 protruding perpendicular from the modular anechoic panel 40 toward the interior 24 of the anechoic chamber 20, wedge base 72 and airspace 76 contained within modular anechoic panel 40. According to previous techniques, wedge tips 60, 62, and 64 are constructed of a sound-absorptive material and have angular wedge-shaped bodies. The angular shape of wedge tip 64 provides the high surface area necessary for absorbing sound emissions 30. Preferred sound absorptive materials used in the past to construct wedge tips 60, 62, and 64 include various low-rigidity materials such as fiberglass and foam. (While melamine is the foam material of choice, it is extremely costly on a volume basis). Wedge base 72 similarly may be constructed of any sound-absorptive material that has "blow through" (i.e., that allows sound to pass through it) and has a density higher than the material comprising the wedge tip 64. Preferably, wedge base 72 is constructed of multiple layers of type-703 fiberglass 74. The wedge tip 64, wedge base 72 and air space 76 configuration provides a density change over the length of the anechoic wedge 70 which assists in eliminating sound reflections. Accordingly, the elements of wedge base 72 and air space 76 are contained within modular anechoic panel 40, as compared with previous techniques which disposed the wedge base and the air space elements within the interior surface of the anechoic chamber's shell, resulting in difficulty in assembly and repair.

Figure 4:
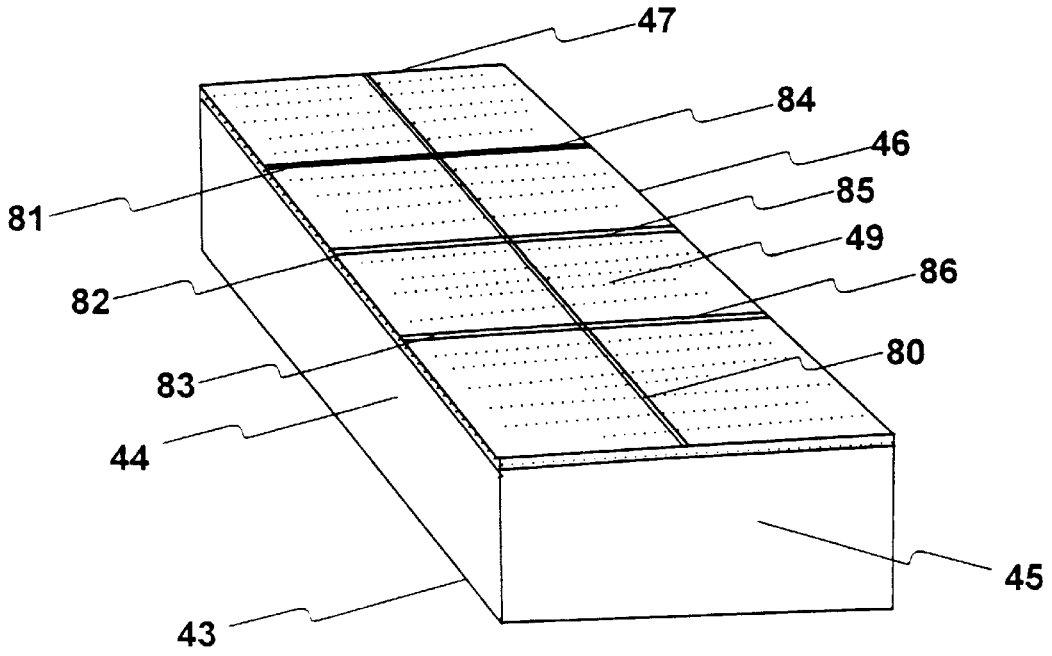
FIG. 4 is an isometric view of an illustrative embodiment of an assembled modular anechoic panel.
Figure 5:
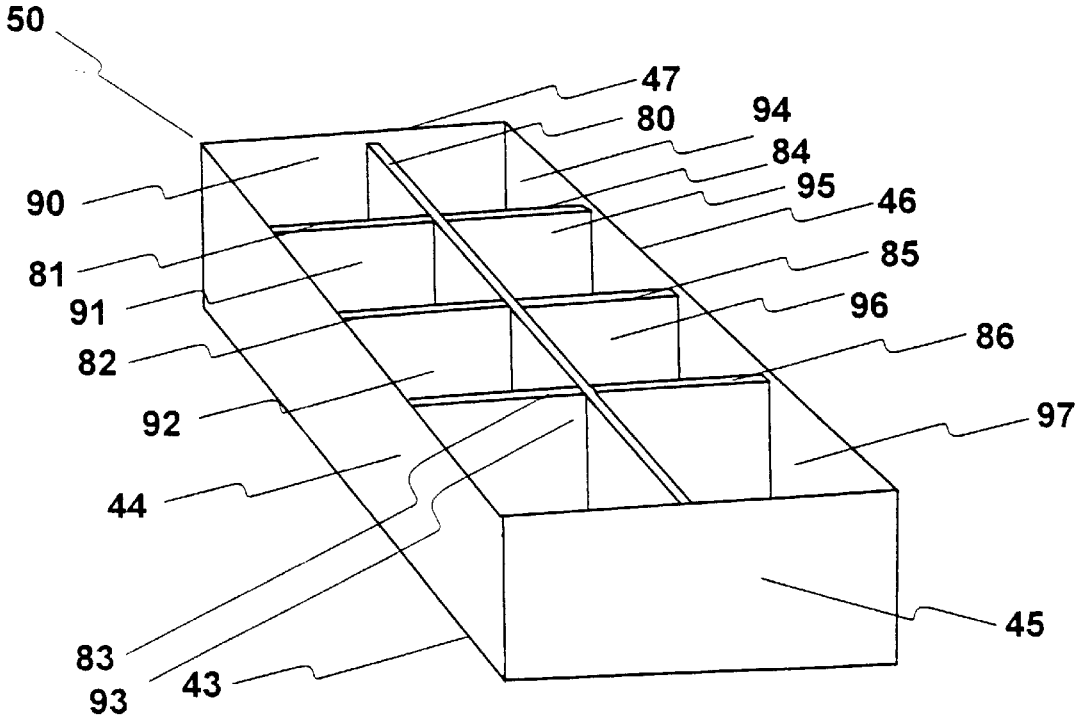
FIGS. 5 through 7 are isometric cut-away views revealing the internal construction and partitioning into zones and cells of an illustrative embodiment of a modular anechoic panel.

FIGS. 4 through 7 detail the internal components and construction of an illustrative embodiment of the modular anechoic panel 40. As shown in FIG. 4, modular anechoic panel 40 of the illustrative embodiment includes back wall 43, side walls 44, 45, 46, and 47 and face plate 49. Back wall 43 and side walls 44, 45, 46, and 47 preferably are formed from material having suitable structural integrity to provide rigidity, strength and durability, such as 16-gauge steel permanently joined. However, back wall 43, and side walls 44, 45, 46 and 47 may alternatively be constructed of any rigid structural material. Face plate 49 is an acoustically transparent sheet having structural integrity, preferably 22-gauge perforated steel. Perforations 49 permit sound emissions 30 from a specimen 32 within anechoic chamber 20 to pass substantially unimpeded into the modular anechoic panel 40. Conventional mounting methods such as pop rivets mount face plate 49 to side walls 43, 44, 45, and 46 and fix the position of the internal components of modular anechoic panel 40.

A method of forming modular anechoic panel 40 is shown in more detail in FIGS. 5 through 8. Center partition 80 and fiberboard Lateral partitions 81, 82, 83, 84, 85, and 86 partition the housing 50 (formed by the back wall 43 and side walls 44, 45, 46, and 47) into eight 24" by 24" multiple zones 90 through 97. Preferably each partition 80 through 86 is constructed from rigid fiberboard. In each zone 90 through 97, a sheet of transmission loss material 110, preferably a 1" thick gypsum sheet, rests against and covers interior surface 58 of back wall 43. Transmission loss material 110 may be fixed into position using connection techniques such as glue. Transmission loss material 110 assists in reducing sound from passing into anechoic chamber 20 from the exterior 23. A wedge-base supporting member 111 retains the multiple fiberglass layers 74 of wedge base 72 in an elevated position from transmission loss material 110 to create air space 112. In the illustrative embodiment, an acoustically transparent shelf 114 with supporting legs 116 and 118, each preferably constructed of 22-gauge perforated steel to permit sound transmission, form the wedge-base supporting member 111. The region bounded by the acoustically transparent shelf 114 and transmission loss material 110 forms air space 112, which is critical to the sound-absorption function of anechoic wedge 70. Though wedge-base supporting member 111 of the illustrative embodiment is disclosed as an acoustically transparent shelf 114, alternate mounting and support methods may be employed.

Figure 6:
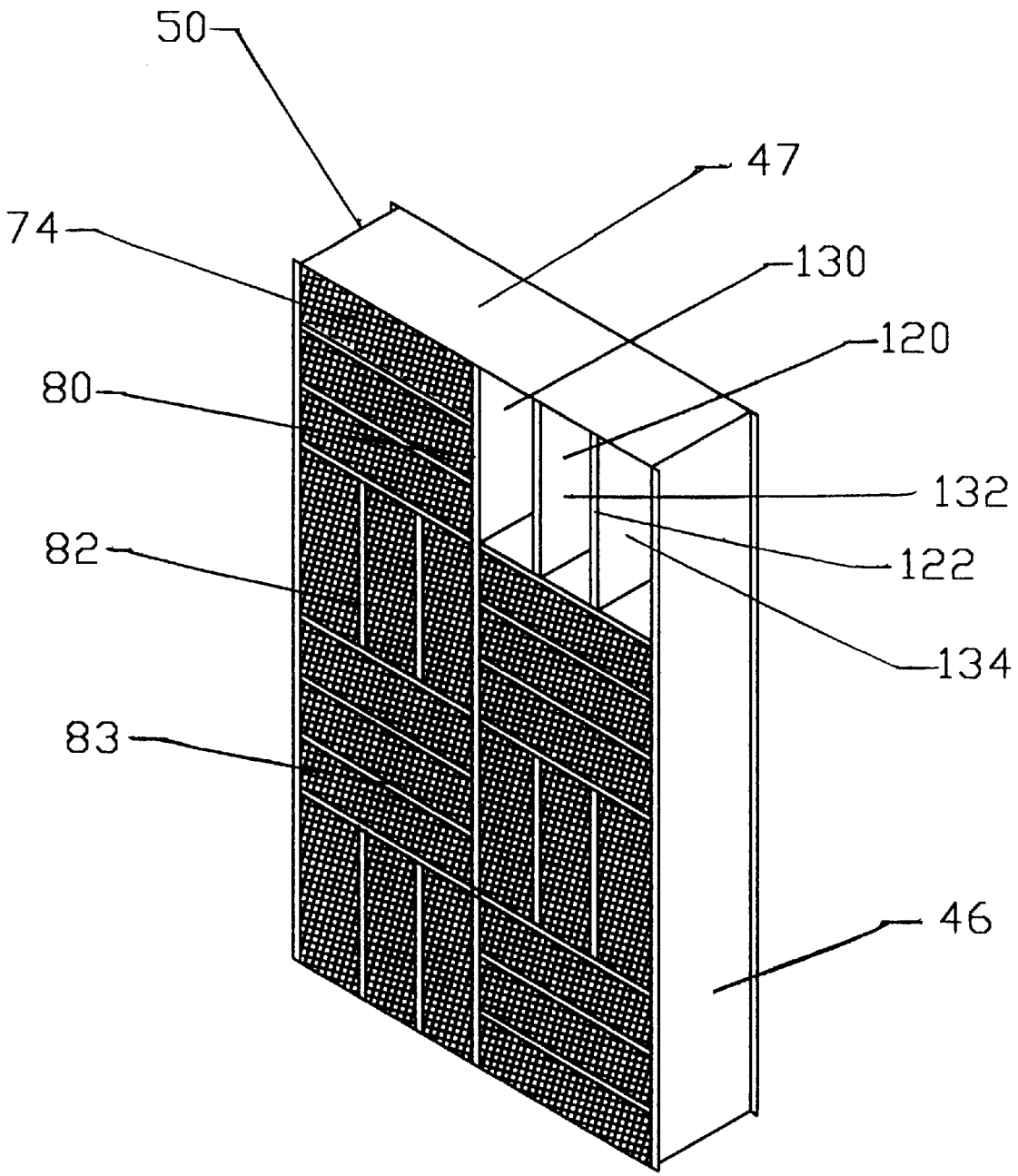
Figure 7:
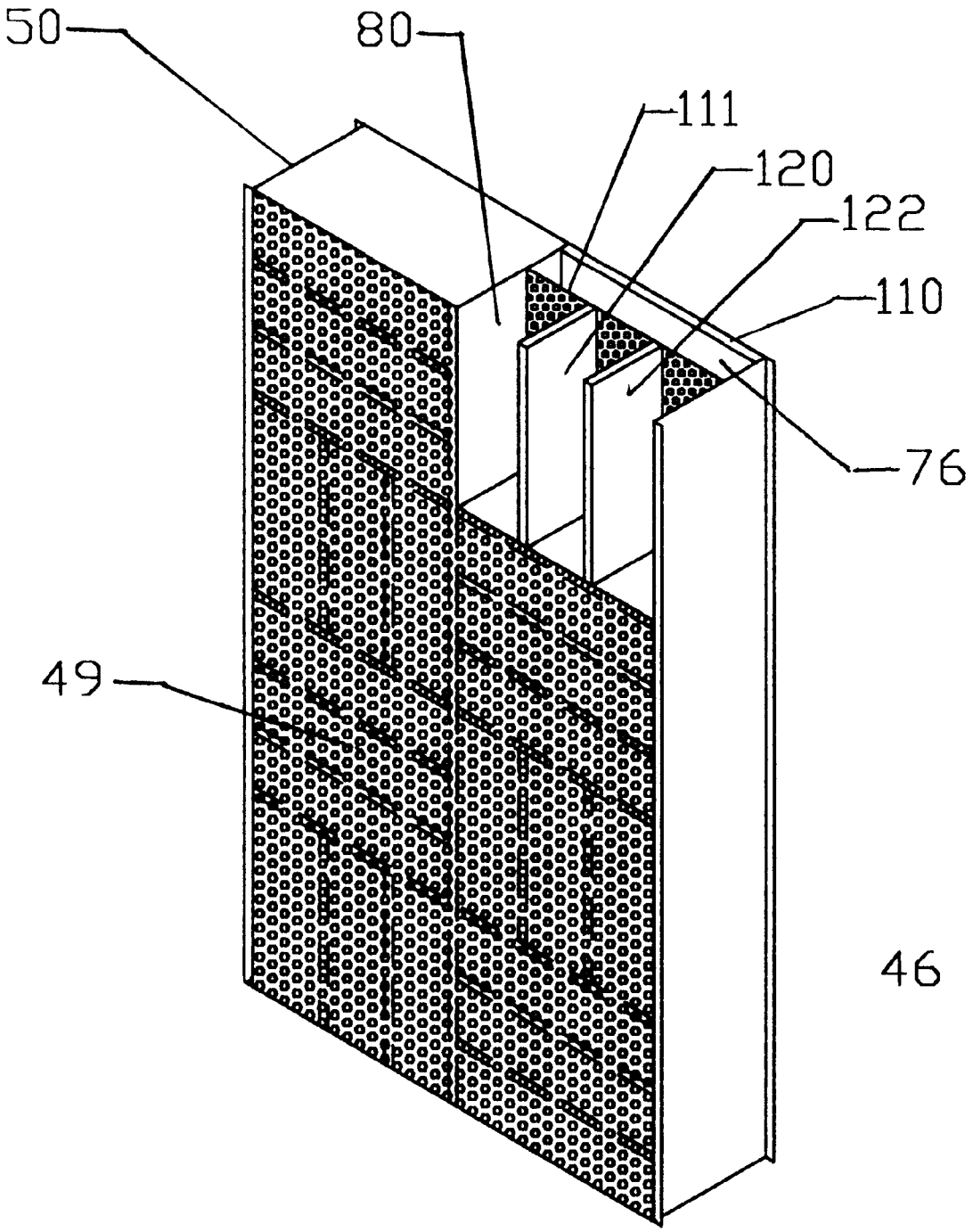
Figure 8:
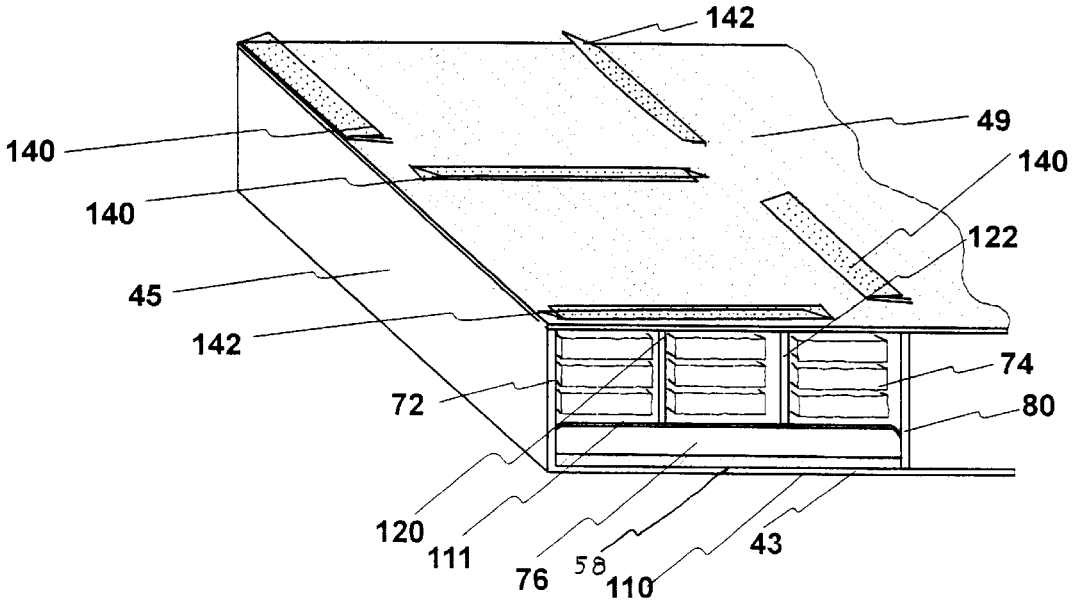
FIG. 8 is an isometric cut-away view showing the internal elements of an illustrative embodiment of a modular anechoic panel with the wedge tip compression clip system mounted upon the face plate.

As shown in FIGS. 6, 7 and 8 detailing the internal structure of modular anechoic panel 20, cross members 120 and 122 preferably constructed of ½ rigid fiberglass, rest vertically on acoustically transparent shelf 114 and further partition each zone 90 through 97 into rectangular cells 130, 132, 134. The multiple fiberglass layers 74 of the wedge base 72 are then layered in each cell 130, 132, 134. The multiple fiberglass layers 74 are preferably type-703 fiberglass, however, other suitable acoustic dampening materials well known in the art may be employed.

As shown in FIGS. 7 and 8, upon assembly of the interior components of the modular anechoic panel 40, face plate 49 may be fastened into place by means such as pop-riveting to lock the interior components into position. Final assembly includes mounting of a series of wedge tip compression clips 140 and 142 to face plate 49, which may be accomplished by conventional mounting means such as pop rivets.

Figure 9:
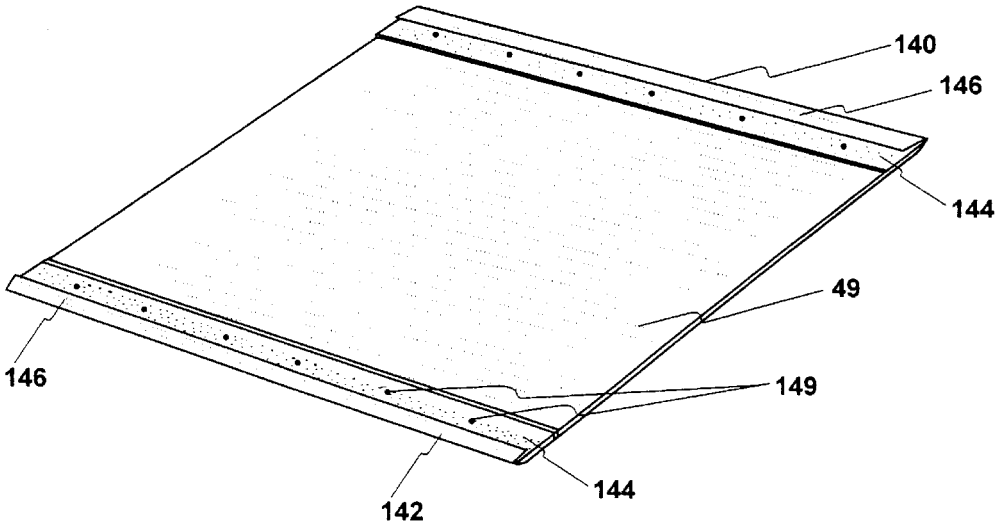
FIG. 9 is an isometric view illustrating the wedge tip compression clip system disposed upon the surface of the face plate.

FIG. 9 illustrates an illustrative embodiment of the wedge tip compression clip system in further detail. The wedge tip compression clip system includes alternating pairs of compression clips 140 and 142 each having a base 144 and an angle bracket 146. Compression clips 140 and 142 are preferably constructed of an acoustically transparent material, such as perforated steel, to minimize any chance of sound reflections. In the illustrative embodiment, clip base 144 of each compression clip 140 and 142 mount to face plate 49 by means of pop-rivets 149.

Figure 10:
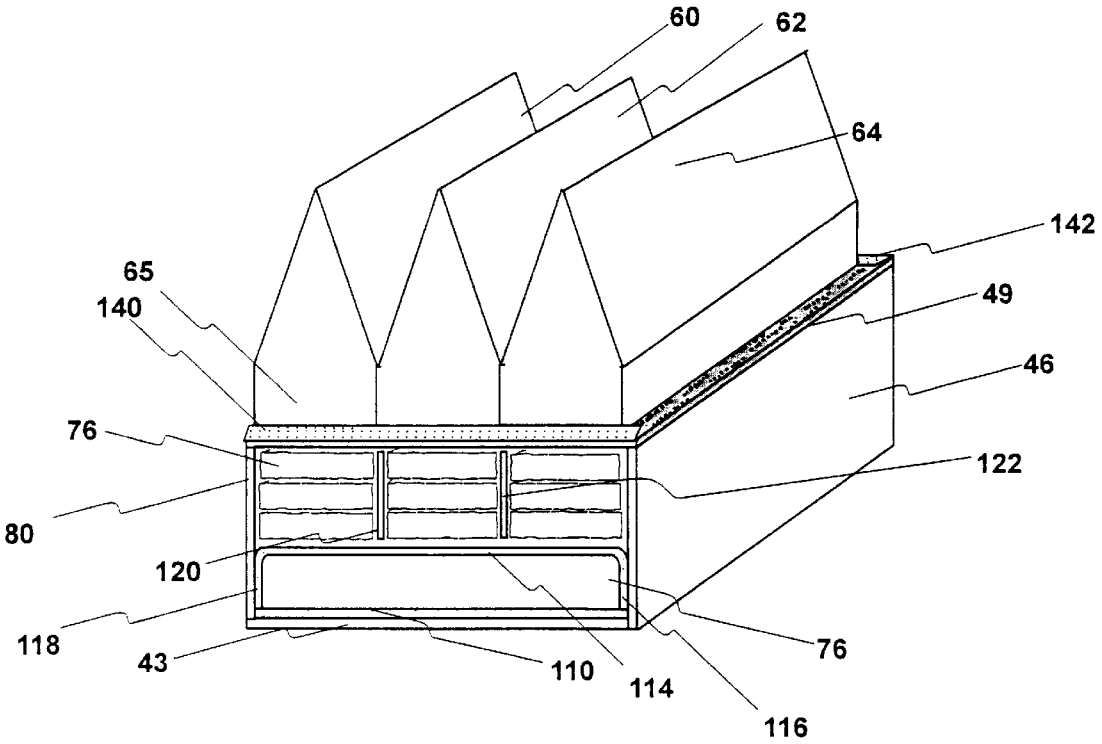
FIGS. 10 and 11 are isometric and side cut-away views illustrating a three cell zone of a modular anechoic panel and showing the mounting of a set of wedge tips.
Figure 11:
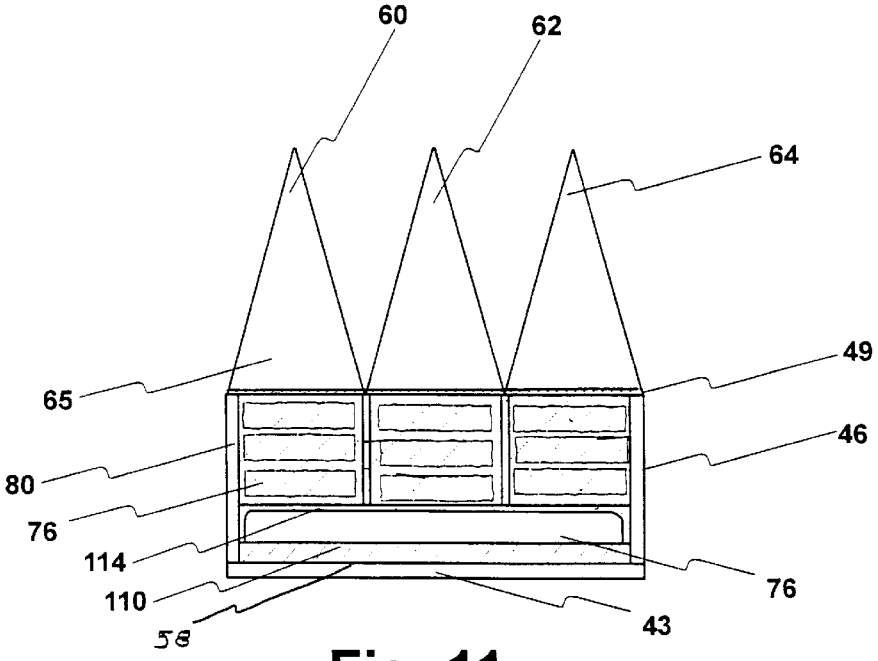

As illustrated in FIGS. 10 and 11, wedge tips 60, 62, and 64 easily mount against the exterior surface 41 of the face plate 49 using compression clips 140 and 142. Compression clips 140 and 142 are positioned to align wedge tips 60, 62 and 64 with cells 130, 132 and 134. In the illustrative embodiment, wedge tips 60, 62 and 64 preferably consist of a melamine material, which has a spongy-elastomeric quality. Accordingly, wedge bottom 65 may be compressed to allow wedge tip 60 to be aligned and inserted between compression clips 140 and 142. Upon release of wedge tip bottom 65, angle brackets 146 will impinge upon wedge tip bottom 65 to hold wedge tip 60 in position. Each pair of compression clips 140 and 142 maintains three wedge tips 60, 62 and 64 flush to the face plate 49 and in alignment with the underlying fiberglass layers 74 of acoustical dampening material 66 in each cell 130, 132, and 134. With relative ease, a person may selectively insert and remove wedge tips 60, 62 and 64 by compressing the bottom 65 of the selected wedge tip and either inserting it into or removing it from a position between angle brackets 146 of compression clips 140 and 142.

As revealed in FIGS. 2, 7, 8 and 10, the configuration of each cell 130, 132, 134 and wedge tip 60, 62 and 64 of the fully assembled modular anechoic panel 40 constitutes an acoustic anechoic wedge 70.

Figure 12:
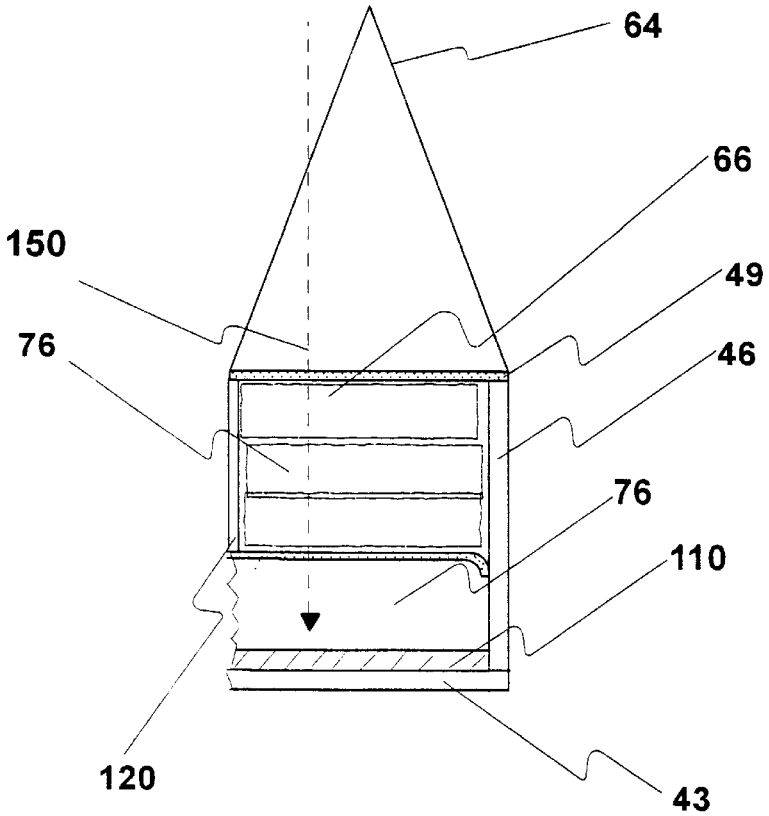
FIGS. 12 and 13 are side and longitudinal cut-away views showing the path of dissipated sound energy and the elements that make up a single cell of anechoic wedge in the illustrative embodiment of the modular anechoic panel.
Figure 13:
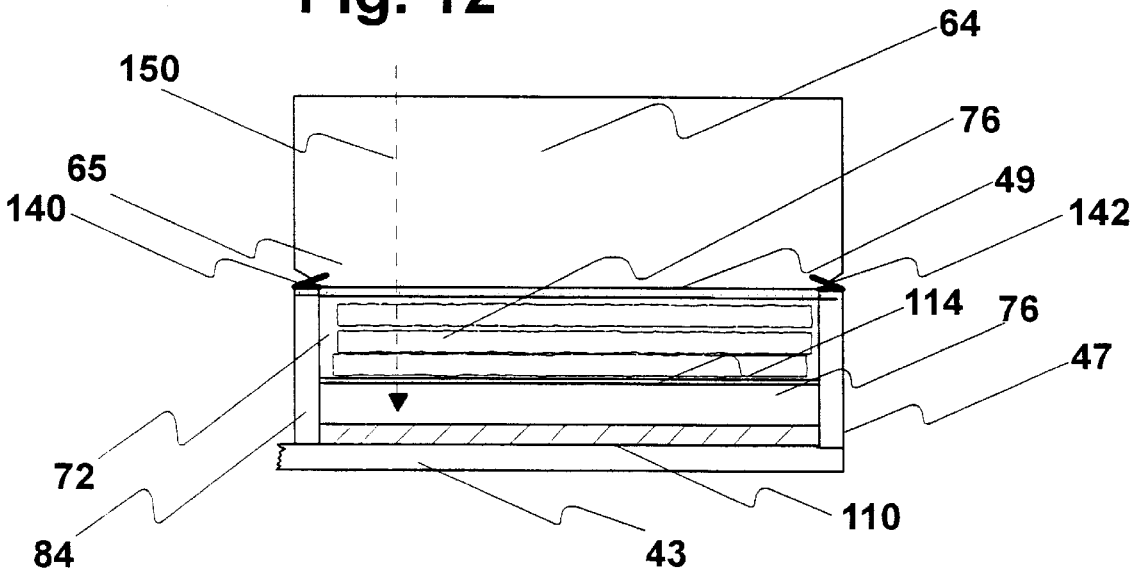

FIGS. 1, 12 and 13 illustrate a single cell constituting the elements of an anechoic wedge 70. In operation, sound emissions 30 from specimen 32 travel along path 150, impacting wedge tip 64 and causing it to vibrate. The vibration energy continues to travel generally along path 150 through the sound-absorptive wedge tip 64, thereby dissipating a portion of the energy. The energy continues through face plate 49 and into the interior of the modular anechoic panel 40. As the energy from sound emissions 30 pass through the higher density multiple fiberglass layers 74 of wedge base 72, the energy is further dissipated. Finally, any remaining energy substantially dissipates in air space 76 before impacting the transmission loss material 110. In similar fashion, transmission loss material 110 and airspace 76 sufficiently dampen any noise that attempts to enter the anechoic chamber 20 from the exterior 23 through the back wall 43.

In the illustrative embodiment, each modular anechoic panel 20 constitutes a single 4'×8'×1' structural member of a wall, ceiling or floor of an anechoic chamber 20. Accordingly, the modular anechoic panel system allows anechoic chamber 20 to be selectively assembled or disassembled. Accordingly, anechoic chamber 20 need not be a permanent fixture and may selectively be broken down for easy storage.

Although an illustrative embodiment and its advantages have been described in detail above, they have been described as example and not as limitation. Various changes, substitutions and alterations can be made in the illustrative embodiment without departing from the breadth, scope, and spirit of the claims.

What is claimed is:

1. A modular anechoic panel, comprising:

a housing comprising, a back wall said back wall having an interior and an exterior surface and a perimeter;

a plurality of side walls having upper and lower margins, said lower margins of said side walls coupled to said perimeter of said back wall;

a face plate having an interior surface and an exterior surface, said face plate coupled to said upper margins of said side walls of said housing;

transmission loss material disposed between said interior surface of said back wall of said housing and said interior surface of said face plate;

a support member located between said face plate and said transmission loss material; and a wedge base disposed between said interior surface of said face plate and said support member.

2. The modular anechoic panel of claim 1 wherein said support member is a shelf.

3. The modular anechoic panel of claim 2 wherein said shelf and said face plate are constructed of an essentially acoustically transparent material.

4. The modular anechoic panel of claim 2 wherein said essentially acoustically transparent material is perforated steel.

5. The modular anechoic panel of claim 1 wherein said wedge base comprises a plurality of layers of acoustic damping material.

6. The modular anechoic panel of claim 1 wherein said wedge base comprises a plurality of layers of acoustic damping material.

7. A modular anechoic panel, comprising:

a housing comprising, a back wall, said back wall having an interior and an exterior surface and a perimeter; and, a plurality of side walls having upper and lower margins, said lower margins of said side walls coupled to said perimeter of said back wall;

a face plate having an interior surface and an exterior surface, said face plate coupled to said upper margins of said side walls of said housing;

a plurality of partitions forming a plurality of zones between the side walls;

transmission loss material disposed within each zone;

support members disposed within each zone between said face plate and said transmission loss material;

a wedge base of layers of acoustic dampening material disposed within each zone between said interior surface of said face plate and said support members.

8. The modular anechoic panel of claim 7 wherein said support members are shelves.

9. The modular anechoic panel of claim 8 wherein said shelves and said face plate are constructed of essentially acoustically transparent material.

10. The modular anechoic panel of claim 9 wherein said essentially acoustically transparent material is perforated steel.

11. The modular anechoic panel of claim 7 wherein said wedge bases comprises a plurality of layers of acoustic damping material.

12. The modular anechoic panel of claim 7, further comprising a plurality of compression clips coupled to said exterior surface of said face plate.

13. A wedge tip compression clip configured to receive a wedge for sound absorption, comprising:

a base having a first end and a second end; and a bracket portion having a first end and a second end, said first end of said bracket portion coupled to said second end of said base and said second end of said bracket portion angled over said base.

14. The wedge tip compression clip of claim 13 wherein said base, angular support and bracket portion are constructed of a unitary body of essentially acoustically transparent material.

15. A wedge tip compression clip system configured to receive a wedge for sound absorption, comprising:

a first compression clip having a base portion and a bracket portion;

a second compression clip having a base portion and a bracket portion disposed distal proximate said first clip; and a plate having an interim surface and an exterior surface, wherein said first compression clip and said second compression clip are attached to said face plate.

16. The wedge tip compression clip system of claim 15, wherein said first clip and said second clip are constructed of essentially acoustically transparent material.

17. The wedge tip compression clip system of claim 16, wherein said acoustically transparent material is perforated steel.

18. A modular anechoic panel system comprising:

(a) at least one modular anechoic panel having (i) a housing comprising, a back wall said back wall having an interior surface and an exterior surface and a perimeter;

a plurality of side walls having upper and lower margins, said lower margins of said side walls coupled to said perimeter of said back wall (ii) a support member having an exterior surface and an interior surface and a perimeter located between the side walls, wherein the interior surface faces the interior surface of the back wall;

(iii) transmission loss material disposed between said interior surface of the back wall of said housing and said support member;

(iv) a face plate having an interior surface and an exterior surface, said face plate coupled to said upper margins of said side walls of said housing;

(v) a wedge base disposed between said interior surface of said face plate and said support member.

(b) a plurality of wedge tip compression clips coupled to said face plate, each compression clip further comprising, a base having a first end and a second end; and, a bracket portion having a first end and a second end, said first end of said bracket portion coupled to said second end of said base and said second end of said bracket portion overhanging said base; and, (c) a plurality of wedge tips selectively attached against said face plate by said compression clips.

19. The modular anechoic panel system of claim 18 wherein the support member is coupled to said side walls.

20. A method for mounting a wedge tip on a sound absorptive chamber, comprising the steps of:

compressing a base of a wedge tip;

inserting said base of said wedge tip between a first compression clip and a second compression clip disposed upon an inner surface of the sound absorptive chamber;

aligning said base of said wedge tip with said compression clips; and, releasing said base of said wedge tip.

21. The method for mounting of claim 20 wherein the sound absorptive chamber is an anechoic chamber.

* * * * *